US005528996A

United States Patent [19]

Edwards et al.

[11] Patent Number: 5,528,996

[45] Date of Patent: Jun. 25, 1996

[54] TABLE LEG SUPPORT ASSEMBLY AND METHOD

[75] Inventors: Larry Edwards; Mark Wubben, both of Muscatine, Iowa

[73] Assignee: Hon Industries Inc., Muscatine, Iowa

[21] Appl. No.: 227,945

[22] Filed: Apr. 15, 1994

[51] Int. Cl.[6] ..... A47B 57/00

[52] U.S. Cl. ..... 100/64; 108/158; 248/188

[58] Field of Search ..... 108/157, 158, 108/159, 64, 156; 288/188, 188.1

[56] References Cited

U.S. PATENT DOCUMENTS

| | | | |
|---|---|---|---|
| 527,148 | 10/1894 | Dempsey | 248/188 |
| 692,506 | 2/1902 | Ecker | 248/188 X |
| 3,126,189 | 3/1964 | Van Syoc, Sr. | 248/188 |
| 3,230,908 | 1/1966 | Grant | 108/64 X |
| 3,865,050 | 2/1975 | Cecchetti | 108/156 X |
| 4,187,786 | 2/1980 | Feig et al. | 108/64 |
| 4,731,918 | 3/1988 | Burghardt | 108/156 X |
| 5,232,303 | 6/1993 | Rubner | 248/188 X |
| 5,341,749 | 8/1994 | Noakes | 108/64 |

*Primary Examiner*—José V. Chen
*Attorney, Agent, or Firm*—Jones, Day, Reavis & Pogue

[57] ABSTRACT

A leg support assembly for a table includes a leg support member, which receives and retains a table leg, and a connector which is attachable to the underside of a table top. The support member has a plurality of plugs which are receivable in sockets provided in the connector plate. When the connector plates are fastened to the corners of two abutting table tops, the leg support member can be mated with two connector plates thereby spanning the joint between the tables and providing support for a single leg. Thereby, the duplication of legs at the table joint is eliminated.

36 Claims, 6 Drawing Sheets

TABLE LEG SUPPORT ASSEMBLY AND METHOD

BACKGROUND OF THE INVENTION

1. Field of the Invention

The present invention relates generally to a table leg support assembly and, more particularly, to a leg support assembly which conveniently permits a plurality of tables to be easily interconnected in alternative configurations with a minimum number of legs. The invention also relates to a method of assembling table tops in a wide variety of geometric configurations with a minimum number of legs.

2. Description of the Prior Art

In office and hotel environments it is frequently desirable to take modular rectangular table sections and arrange them to achieve a particular geometric configuration. Individual table sections can be arranged lengthwise, for example, to create an elongated table, or in an L-configuration if desired. However, when tables are thus arranged, the resulting unit has more legs than is necessary to achieve a sturdy and pleasant-looking assembly. In a lengthwise configuration, for example, pairs of legs are duplicated at the joinder of two adjacent table sections. In an L-configuration similar duplication of legs occurs at the two juxtaposed corners of the tables. The resulting assembly thus appears to be haphazardly or crudely assembled. Moreover, the arrangements available, limited by the generally rectangular planar configuration of the table top, are often less efficient than desired. Accordingly, it is desirable to provide a table leg support system which permits sectional table tops of different configurations to be interconnected in a variety of configurations with a minimum number of legs. It is further desirable to provide a leg support system which permits multiple tables to be reconfigured from one geometric assembly to another with a minimum of effort.

SUMMARY OF THE INVENTION

The present invention provides a table leg support assembly comprising a connector plate adapted to be fastened to the underside of a table top at a corner or edge thereof. The connector plate has a plurality of recesses formed in it. A leg support is provided comprising an integrally formed collar and flange. The collar is adapted to receive and retain a table leg. The flange has projections or plugs corresponding in number to the number of recesses in the connector plate and adapted to be received within the recesses. The connector plates are so spaced from the edges of the table tops that when two adjacent tops are to be joined, a leg support may be positioned spanning the joint between the adjacent tables, with the plugs in registry with recesses of two juxtaposed connector plates. Accordingly, instead of two legs providing support for the two adjacent table top sections, support is provided by a single leg interconnecting both tables. A single leg arrangement thus contributes to a more aesthetically pleasing table assembly. Moreover, this permits table tops of different planar configurations also to be easily joined.

BRIEF DESCRIPTION OF THE DRAWINGS

The features and advantages of the invention will become apparent from the following detailed description taken in connection with the accompanying drawings wherein.

DESCRIPTION OF THE PREFERRED EMBODIMENT

Figure 1:
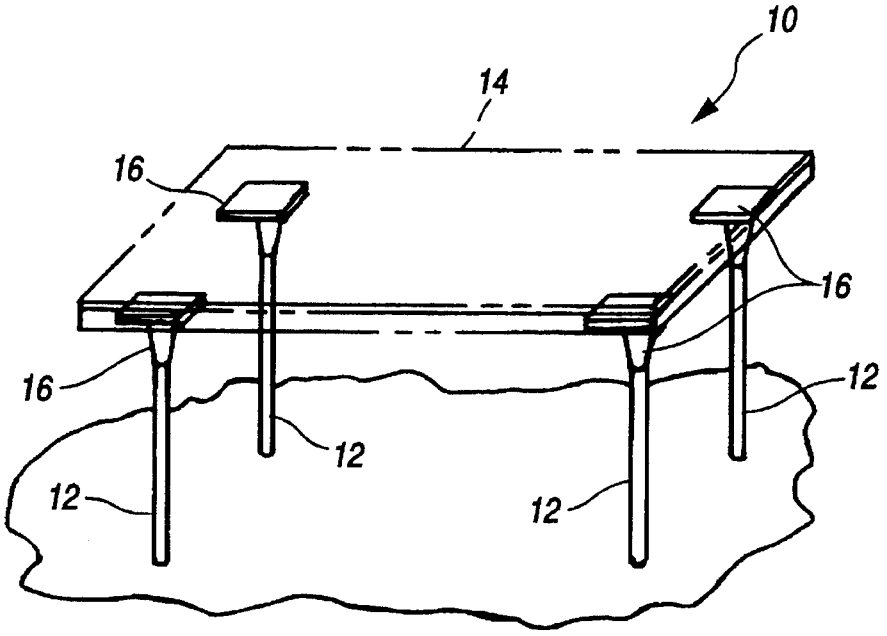
FIG. 1 is a perspective view of a simple single table (in phantom) assembly having leg support assemblies in accordance with the present invention.
Figure 2:
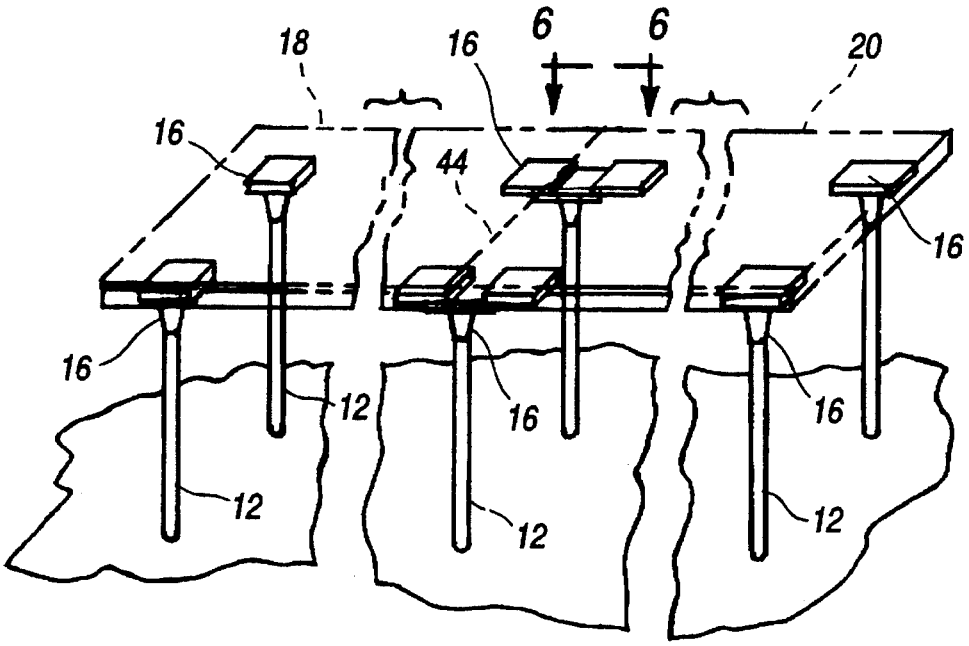
FIG. 2 is a perspective view of a pair of similar tables (in phantom) joined together with leg support assemblies of the present invention.

Turning now to the drawings, and initially to FIG. 1, there is shown a table assembly, designated generally by the reference numeral 10, having legs 12 connected to a table top 14 (in phantom) by leg support assemblies 16 in accordance with the invention. FIG. 2 illustrates a pair of tables 18 and 20 joined together using the leg support assemblies 16 in a manner which will be described in detail hereinafter.

Figure 3:
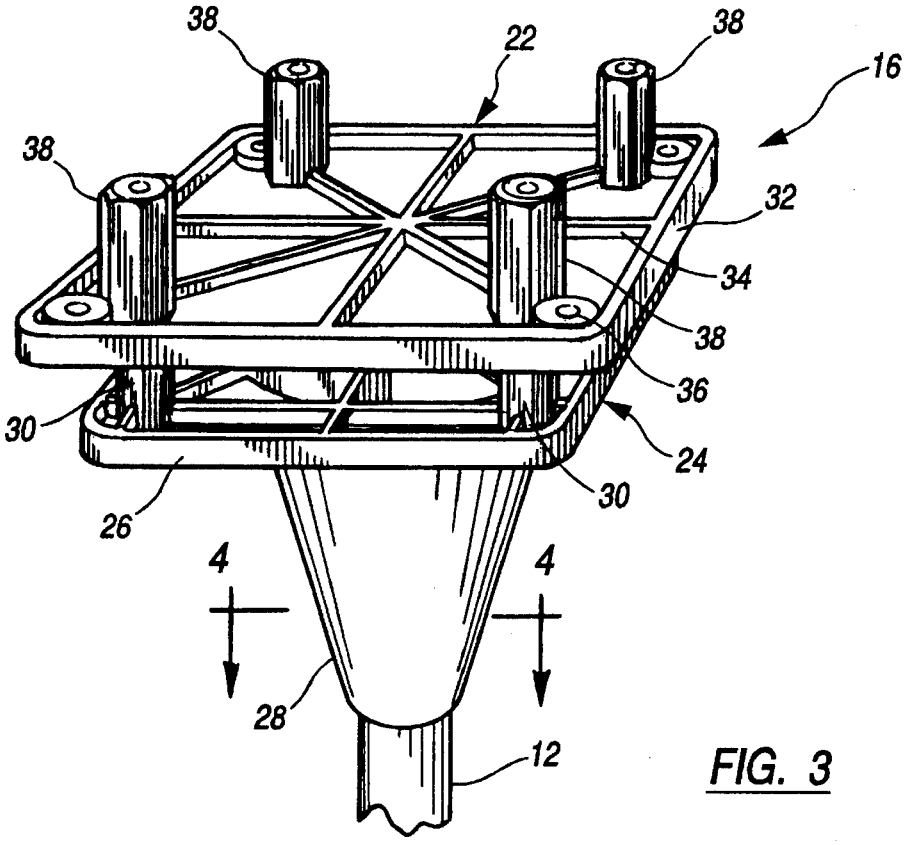
FIG. 3 is a perspective view of the leg support assembly of the present invention.
Figure 4:
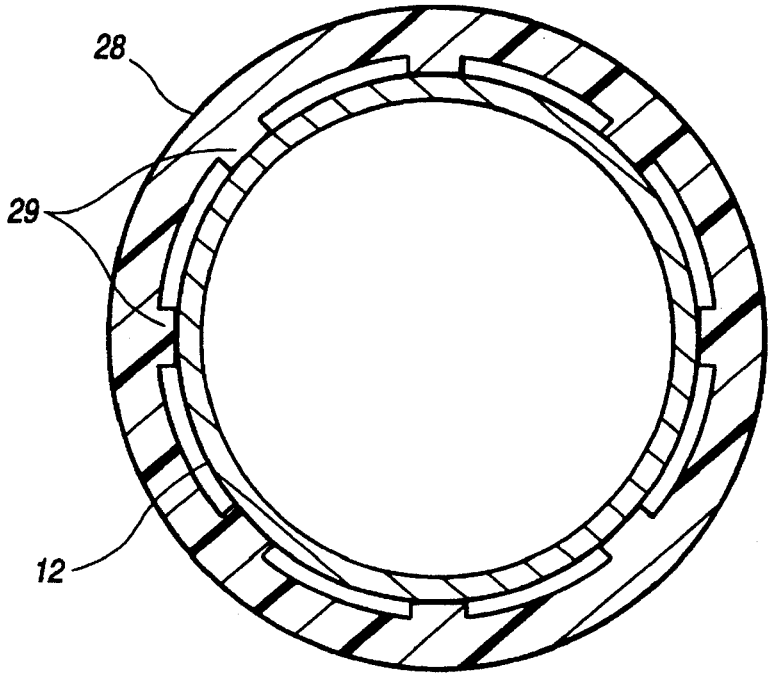
FIG. 4 is a cross-sectional view taken substantially along the line 4—4 of FIG. 3.

Referring now to FIG. 3, the leg support assembly 16 includes a connector plate 22 and a mating leg support member 24. The leg support member 24 is preferably an injection molded plastic member and comprises a flange 26 in the form of a square and an integrally formed collar 28. The collar 28 is suitably formed to telescopically and frictionally receive and retain table leg 12. As best seen in FIG. 4, suitable ribs formed on the inside wall of the collar 28 provide for frictional engagement of the collar 28 with the leg 12. Extending upwardly from the flange 26 in proximity to each of the corners thereof are projections, or plugs 30.

Figure 5:
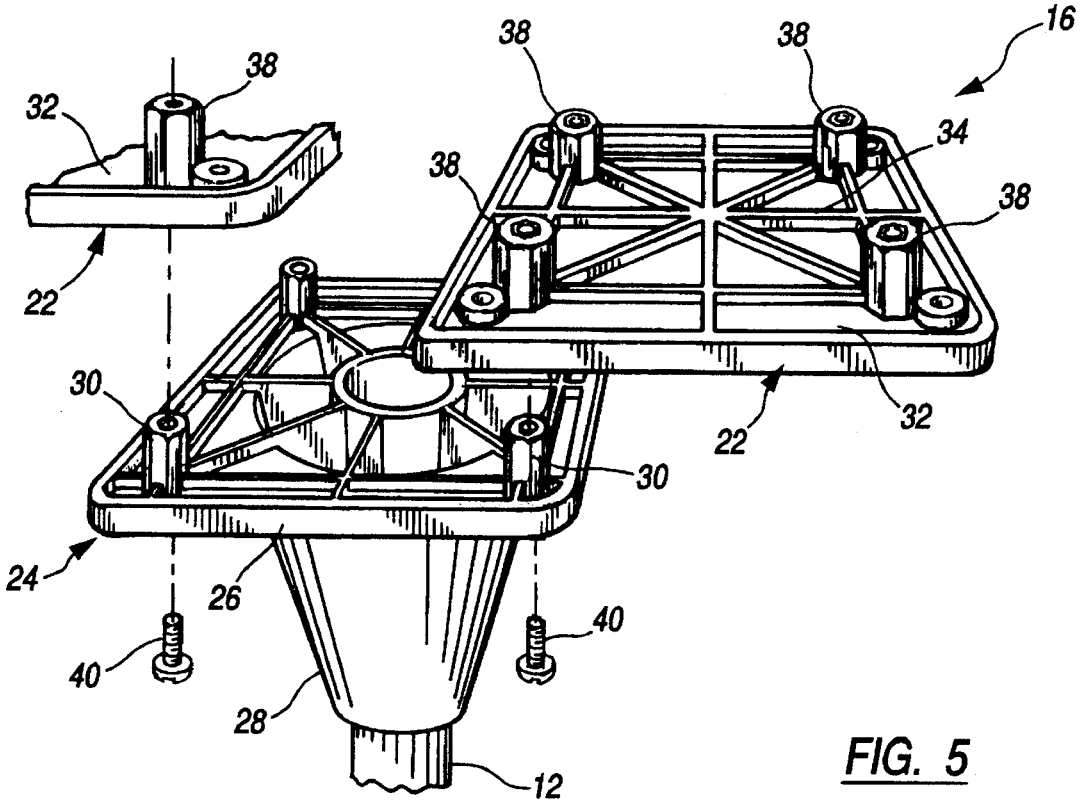
FIG. 5 is an exploded perspective view illustrating the use of the leg support assembly in accordance with the invention.
Figure 6:
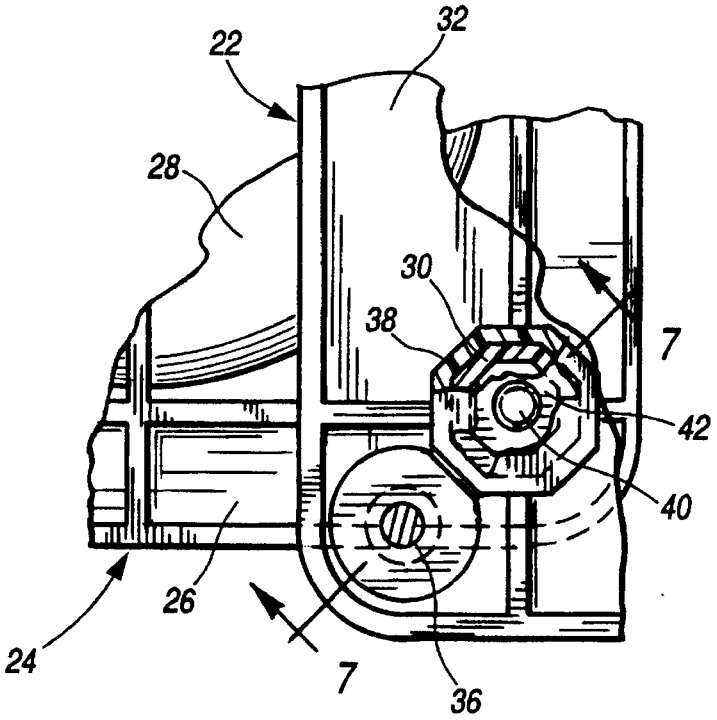
FIG. 6 is a fragmentary bottom plan view of the present leg support assembly.

As seen in FIGS. 3 and 5, the connector plate 22 includes a square plate portion 32 having suitable strengthening ribs 34. At each corner, the plate portion 32 is provided with apertures 36 for receiving screws 37 and for fixedly attaching the connector plate 22 to the underside of a table top 14, as best seen in FIG. 6. Extending upwardly from the plate portion 32 are a plurality of recesses or sockets 38. The connector plates are intended to be permanently affixed to an associated table top, and to this end recesses 39 may be provided in the underside of the table top to receive the sockets 38. The sockets 38 are hollow members complementary configured to receive the plugs 30 of the leg support member 24. When the assembly 16 is installed, each plug 30 of the leg support member 24 is in registry with and received by a complementary socket 38 of the connector plate 22. Each plug 30 is secured to the sockets 38 by a suitable screw 40 and nut 42 arrangement. Accordingly, the connector plate 22 is fixedly secured to the underside of a table top 14 and the leg support member 24 is removably secured to the connector plate 22 thereby providing a firm support assembly 16 for a table leg 12.

In accordance with the invention, as best seen in FIG. 3, a support member 24 can selectively be mated with a single connector plate 22, when it is desired to use the assembly 16 as a leg support for the corner of a table. Alternatively, as seen in FIGS. 2 and 5, a support member 24 can be used with two connector plates 22 to span the joint 44 formed by two abutting table tops 18 and 20. Thus, each table top 18 and 20 can be fitted with connector plates 22 at each of the corners, and the tables 18 and 20 can be selectively joined together in a variety of configurations with adjacent tops sharing common legs 12. The result is that when tables 18 and 20 are joined together, duplication of legs 12 at the joint 44 between the tables 10 is eliminated, making the combination of tables 18 and 20 appear to be intentionally designed as a larger table unit. Moreover, joining of the tables also precludes inadvertent displacement in use.

Figure 8:
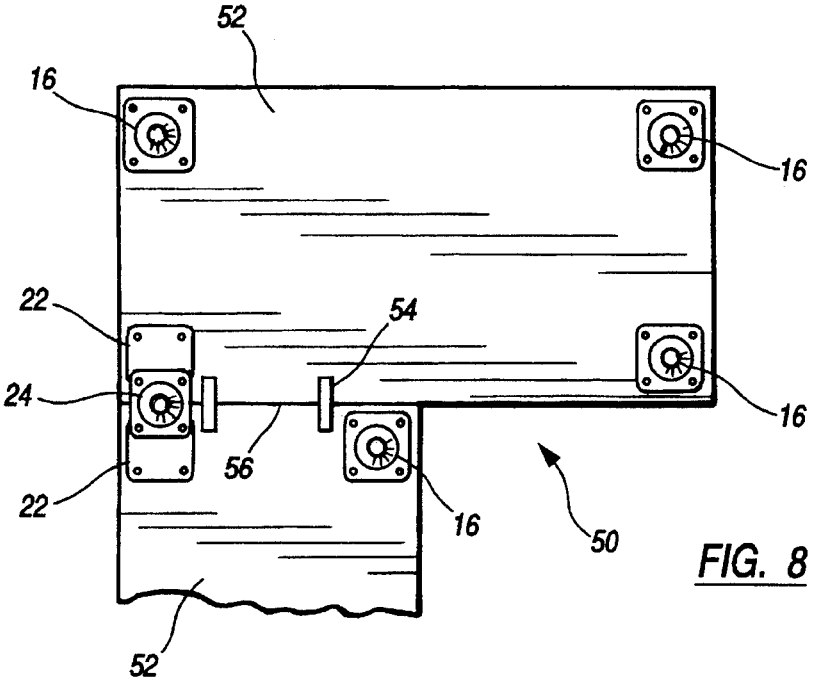
FIG. 8 is a bottom plan view of one configuration of a table assembly in accordance with the invention.

Although a combination of two rectangular top tables 18 and 20 have been illustrated in FIG. 2, it can be appreciated that any number of tables can be joined together. Further, as part of the present invention a variety of table top configurations and systems are possible. As illustrated, for example, in FIG. 8, an L-configuration 50 is achieved by joining two elongated table tops 52 along an end of one table and a side of the other table. Leg support member 24 is shown as shared between two connector plates 22. If desired, simple metal brackets 54 may be attached by screws to the respective table tops 52 spanning the joint 56 between the tops 52. The brackets 54 serve to more rigidly hold the joint 56 together so that the connected tops 52 act as a unit for a more permanent type of setup. Steel brackets 54 may be replaced by a hook and loop fastening means when a less permanent assembly is desired.

Figure 9:
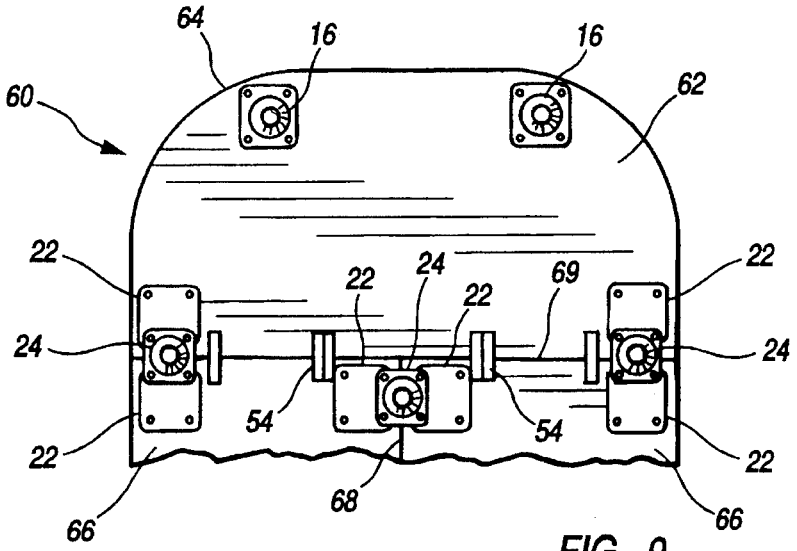
FIG. 9 is a bottom plan view of another table assembly configuration.

Turning now to FIG. 9, another possible table assembly 60 configuration is illustrated having a table top 62 with a curvilinear edge 64. Two rectangular tops 66 share a common leg support member 24 along abutting edge joint 68, while each top 66 shares a common leg support member 24 with an end table top 62 along an abutting edge joint 69. Again, suitable brackets 54 or the like may be used to strengthen the joint 69.

Figure 10:
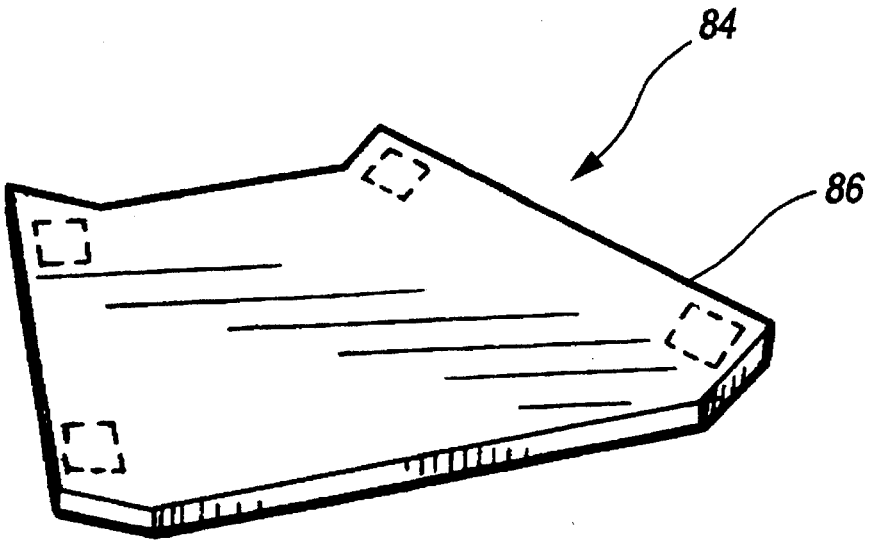
FIG. 10 is a perspective view of a 60° angle table top having leg support assemblies shown in phantom.
Figure 11:
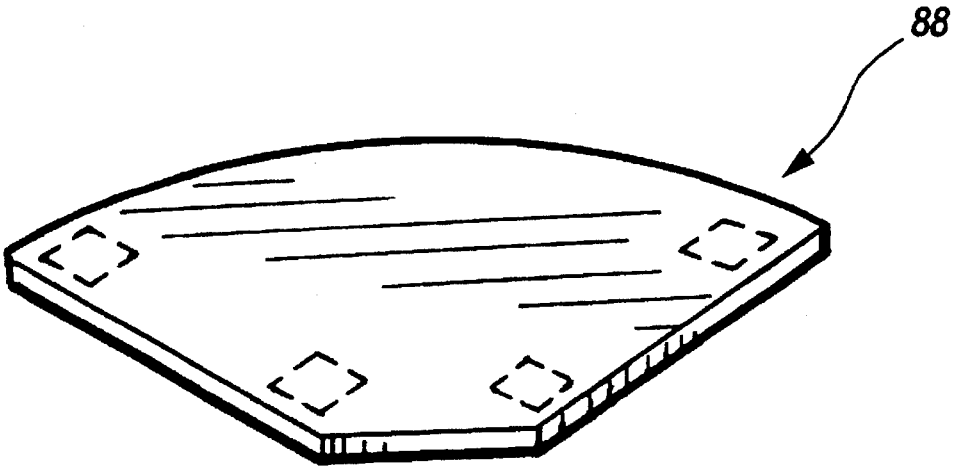
FIG. 11 is a perspective view of a corner table top having leg support assemblies shown in phantom.

In FIGS. 10 and 11 there are shown table tops having other shapes in plan view, such as a 60 degree table 84 in FIG. 10 and a corner table 88 in FIG. 11. Each table is shown with connector plates 22 positioned adjacent a straight or rectangular edge and approximately where the edge changes direction. For purposes of this application, the term "corner" is intended to be inclusive of such geometric arrangement and is not intended to be limited to any absolute intersection of two rectangular edges.

Figure 12:
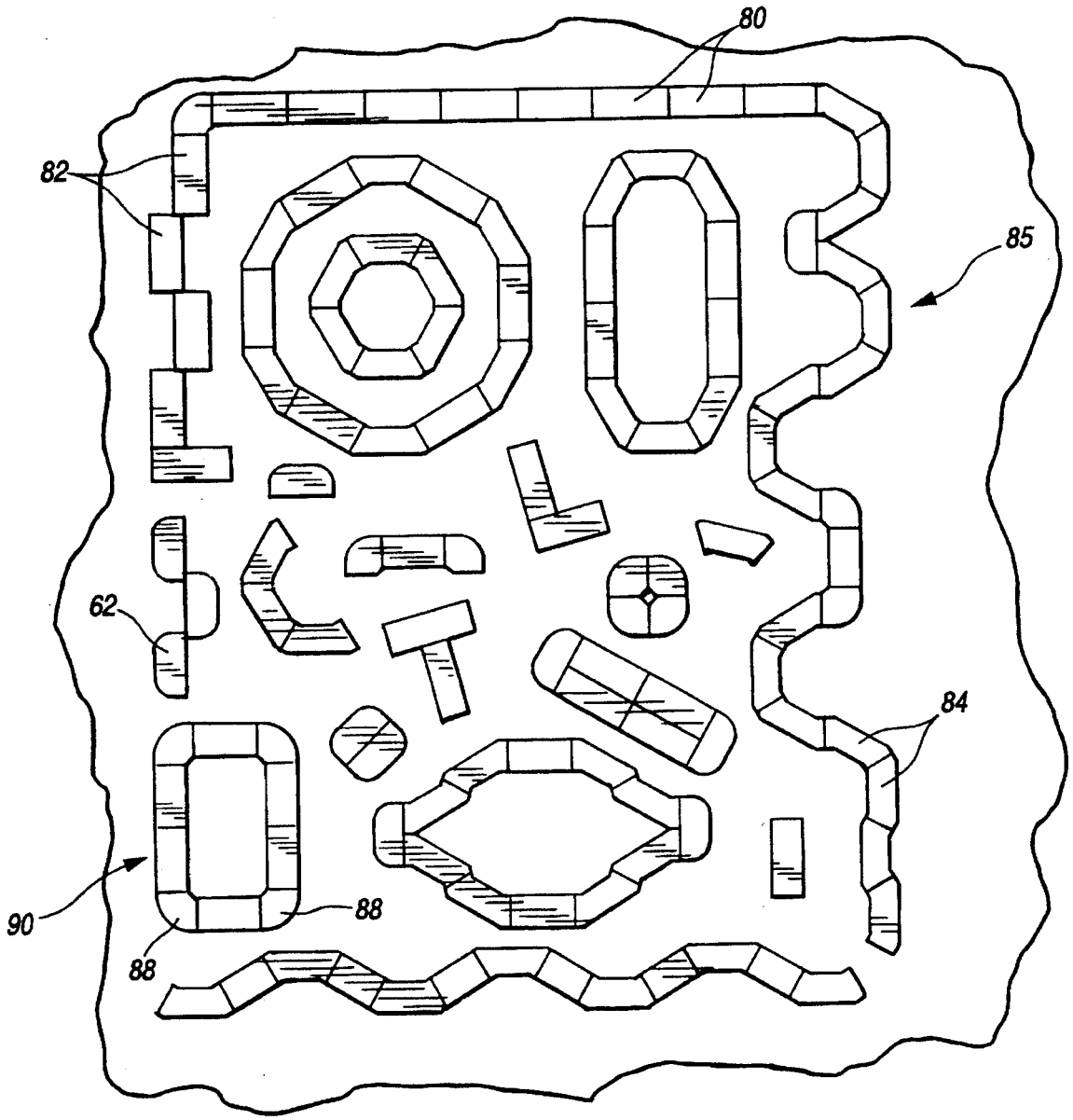
FIG. 12 is a top plan view of table assemblies illustrating a variety of assembled configurations with table tops of various planar configurations.

It can now be appreciated that numerous table assembly configurations are possible with the use of leg support assemblies 16 in accordance with the invention. In FIG. 12, for example, generally rectangular tops 80 are shown joined together as hereinabove described in end-to-end relation. Alternatively, rectangular tables 82 can be joined together at their corners with a single leg support assembly 16 in staggered relation (shown in the upper left of FIG. 12). Also shown is a table top 84 having the 60 degree angled edges 86. These tops 84 may be joined with common leg support assemblies 16 and combined with rectangular table tops 80 to create any number of serpentine configurations 85. Moreover, the end tables 62, as previously described, can be joined at their corners in staggered configuration like the rectangular tables 80. Also, a plurality of corner tables 88 may be used to create an assembly 90 of the type suitable for a board room table, for example. Because each table top has connector plates 22, at their respective corners, the tables 10 can be used again and again in different configurations by simply detaching and reattaching appropriate leg support members 24 from and to suitable connector plates 22.

Figure 7:
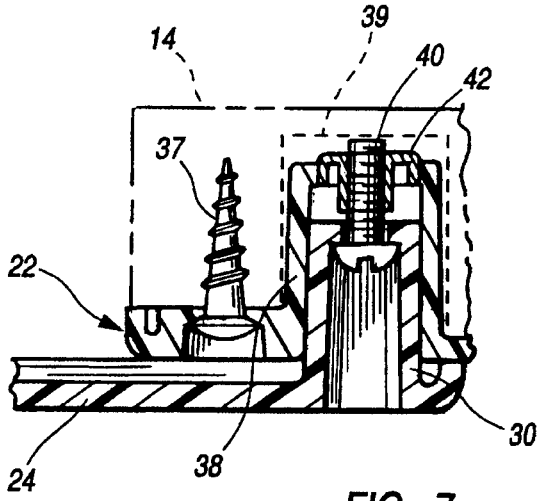
FIG. 7 is a cross-sectional view taken substantially along the line 7—7 of FIG. 6 with the table top shown in phantom.

An important feature of the invention is that although FIG. 7 illustrates the sockets 38 of the connector plate 22 configured as to be received in recesses 39 of the table top 14, the sockets 38 may alternatively project downwardly from the plate portion 32 of the connector plate 22 making it unnecessary to drill recesses 39 into the table top 14. In such case, the sockets 38 may be substituted for plugs to cooperate with suitable sockets formed integrally with the leg support members 24. Moreover, while the sockets 38 and plugs 30 have been shown as octagonal in cross-section to mate securely, these members may be of any cross-section, preferably however complimentary in shape.

While the present invention has been described in connection with particular embodiments thereof, it will be understood by those skilled in the art that many changes may be made without departing from the true spirit and scope of the present invention.

What is claimed is:

1. A support assembly for attaching a leg to a tabletop comprising:

a connector plate adapted to be securely fastened to an underside of a tabletop;

a leg support comprising a collar and a flange, said collar being configured to receive and retain a support leg;

a plurality of interfitting projections and recesses, cooperating between said leg support and said connector plate for mating said leg support to said connector plate; and means for removably securing said leg support to said connector plate.

2. The support assembly of claim 1 wherein said projections are each provided with a through bore for receiving a screw.

3. The support assembly of claim 2 wherein said recesses are each provided with a nut for cooperation with said screw.

4. The support assembly of claim 1 wherein both said connector plate and said flange are square in plan and said recesses and projections are disposed respectively proximate corners thereof.

5. The support assembly of claim 1 wherein said recesses are provided in said connector plate and said projections are provided on said flange.

6. A support assembly for attaching a leg to a tabletop comprising:

a connector plate adapted to be fastened to an underside of said tabletop, said connector plate being square in plan defining four corners and having a recess formed proximate each corner thereof;

a leg support comprising a collar and a flange, said flange being square in plan defining four corners and said collar configured to receive and retain said leg;

projections extending from said flange proximate the corners thereof and configured to be received by said recesses; and means for securing said leg support to said connector plate.

7. A table assembly comprising a plurality of individual table tops, each table top having a peripheral edge with at least one edge of a table top in abutment with an edge of another table top defining a joint therebetween, further comprising:

a connector plate secured to an underside of each abutting table top in proximity with the peripheral edge thereof and adjacent to a connector plate of the abutting table top;

a leg support member for supporting a table leg, said leg support member configured to be secured to a pair of adjacent connector plates spanning the joint between two abutting table tops; and a plurality of interfitting projections and recesses cooperating between said leg support member and said connector plates for mating said leg support member to said connector plates.

8. The table assembly of claim 7 wherein abutting table tops are each generally rectangular in plan and said connector plates are disposed at corners thereof.

9. The table assembly of claim 7 wherein the connector plates each comprise a generally flat plate portion.

10. The table assembly of claim 9 wherein the plate portion of said connector plate is substantially square in plan.

11. The table assembly of claim 9 wherein the plate portion has corners and is provided with a recess at each corner thereof.

12. The table assembly of claim 7 wherein the connector plates are provided with recesses.

13. The table assembly of claim 12 wherein the leg support member is provided with projections for mating with the recesses of the connector plates.

14. The table assembly of claim 7 wherein the leg support member comprises a flange.

15. The table assembly of claim 12 wherein said flange is provided with an integrally-formed collar for receiving and retaining said leg.

16. The table assembly of claim 7 wherein the leg support member is alternatively matable with a single connector plate to provide a leg support for a single table top.

17. The table assembly of claim 7 wherein the leg support member is rigidly secured to said connector plates.

18. The table assembly of claim 7 wherein the leg support member is secured to said connector plates by screws.

19. The table assembly of claim 7 wherein said connector plate is secured to said table top by screws.

20. A method for forming a table assembly from a plurality of individual table tops wherein said table tops have peripheral edges comprising the steps of:

positioning a first table top with one of its peripheral edges in abutment with a peripheral edge of a second table top defining a joint therebetween;

securing a first connector plate to said first table top in proximity to said joint, said first connector plate having at least one recess;

securing a second connector plate to said second table top in proximity to said joint in juxtaposed relation to said first connector, said second connector plate having at least one recess;

providing a leg support member having means for supporting a table leg and including at least one pair of spaced projections;

mating said projections with said recesses such that said leg support member spans said joint; and securing said leg support member to both of said connector plates such that said leg support member rigidly retains said tabletops in assembled relation.

21. A table assembly comprising a plurality of individual table tops each having a peripheral edge in abutment with a peripheral edge of an adjacent table top defining a joint therebetween, wherein a first and second table top abut each other at a substantially linear first edge defining a first joint and a third table top abuts said first and second table tops at a substantially linear second edge defining a second joint comprising:

a first connector plate secured to the underside of said first table top in proximity to said second joint;

a second connector plate secured to the underside of said third table top in proximity to said second joint and juxtaposed from said first connector plate;

a leg support having means to support a table leg; and a plurality of interfitting projections and recesses cooperating between said leg support and said connector plates to span said second joint and retain and said first and third table tops in assembled relation.

22. The table assembly of claim 21 wherein said third table top is provided with a curvilinear edge facing away from said first and second table tops.

23. The table assembly of claim 21 wherein said connector plates each comprise a generally flat plate portion.

24. The table assembly of claim 23 wherein said plate portion is square in plan.

25. The table assembly of claim 24 wherein said plate portion is provided with a recess of each corner thereof.

26. The table assembly of claim 21 wherein the connector plates are provided with recesses.

27. The table assembly of claim 26 wherein said means for supporting a table leg comprises a flange.

28. The table assembly of claim 27 wherein said flange comprises a plurality of projections for cooperation with said recesses.

29. The table assembly of claim 27 wherein said flange is provided with an integrally-formed collar for receiving and retaining said leg.

30. The table assembly of claim 21 wherein said means for supporting a table leg is alternatively cooperable with a single connector plate to supporting said table top.

31. The table assembly of claim 21 wherein said means for supporting a table leg is rigidly secured to said connector plates.

32. The table assembly of claim 31 wherein said means for supporting a table leg is secured to said connector plates by screws.

33. The table assembly of claim 21 wherein said connector plate is secured to said table top by screws.

34. A table assembly comprising at least two table tops joined together, a first table top having a leading edge and a side edge, said edges defining an angle of less than ninety degrees, and a second table top having an edge in abutment with said side edge of said first table top, further comprising:

a first connector plate secured to the underside of said first table top;

a second connector plate secured to the underside of said second table top in juxtaposition to said first connector plate;

a leg support having means for supporting a table leg; and a plurality of interfitting projections and recesses cooperating between said leg support and said connector plates to hold said table tops together.

35. The table assembly of claim 34 wherein said connector plates have recesses and said means for supporting a table leg have projections cooperable with said recesses to hold said joint together.

36. The table assembly of claim 34 wherein the connector plates are located in proximity to corners of said table tops.

* * * * *